US010219326B2

(12) United States Patent
Mosebach et al.

(10) Patent No.: US 10,219,326 B2
(45) Date of Patent: Feb. 26, 2019

(54) METHOD FOR PRODUCING A CABLE CORE, HAVING A CONDUCTOR SURROUNDED BY AN INSULATION, FOR A CABLE, IN PARTICULAR FOR AN INDUCTION CABLE, AND CABLE CORE AND CABLE

(71) Applicant: LEONI KABEL HOLDING GMBH, Nuremberg (DE)

(72) Inventors: Jens Mosebach, Wipperfuerth (DE); Michael Dreiner, Wipperfuerth (DE)

(73) Assignee: LEONI Kabel Holding GmbH, Nuremberg (DE)

( * ) Notice: Subject to any disclaimer, the term of this patent is extended or adjusted under 35 U.S.C. 154(b) by 737 days.

(21) Appl. No.: 14/293,109

(22) Filed: Jun. 2, 2014

(65) Prior Publication Data

US 2014/0263289 A1 Sep. 18, 2014

Related U.S. Application Data

(63) Continuation of application No. PCT/EP2012/004929, filed on Nov. 29, 2012.

(30) Foreign Application Priority Data

Dec. 2, 2011 (DE) ..... 10 2011 087 680

(51) Int. Cl.
*H05B 6/36* (2006.01)
*H05B 6/02* (2006.01)
(Continued)

(52) U.S. Cl.
CPC ..... *H05B 6/02* (2013.01); *E21B 43/2401* (2013.01); *H01B 7/0009* (2013.01); *H05B 2214/03* (2013.01); *Y10T 29/49174* (2015.01)

(58) Field of Classification Search
CPC ..... H01B 7/0009; H01B 7/0045; H01B 7/02; H01B 7/17; H01B 7/40; H05B 6/02;
(Continued)

(56) References Cited

U.S. PATENT DOCUMENTS 4,701,576 A * 10/1987 Wada ..... H01B 7/0233 174/110 F
5,994,682 A 11/1999 Kelly et al.
(Continued)

FOREIGN PATENT DOCUMENTS

CN 1279828 A 1/2001
CN 1667897 A 9/2005
(Continued)

OTHER PUBLICATIONS

English Translation of WO2009109489A1 (included in WO2009109489A1 Document).*
English Translation of CN 2005 10009749.3 (included in CN 2005 10009749.3 Document).*

*Primary Examiner* — Dana Ross
*Assistant Examiner* — Brandon Harvey
(74) *Attorney, Agent, or Firm* — Laurence A. Greenberg; Werner H. Stemer; Ralph E. Locher

(57) ABSTRACT

A production method produces a cable core for an induction cable in a simple and simultaneously reliable manner. In the method, a raw conductor is fed continuously to a processing machine and separated in a recurring manner at specified length positions at a separating point so that there are two wire ends. The ends are then pulled apart from each other in the longitudinal direction of the cable and then connected again by a connector which has an insulating spacer which separates the wire ends from each other by a specified distance. The connector is preferably configured as an injection molded part, in particular using the online process.
(Continued)

A plurality of such cable cores are connected to each other via a cabling process and then enclosed by a cable sleeve to produce the induction cable.

17 Claims, 2 Drawing Sheets

(51) Int. Cl.
*E21B 43/24* (2006.01)
*H01B 7/00* (2006.01)

(58) Field of Classification Search
CPC ..... H05B 6/36; H05B 2206/02; H05B 2206/022; H05B 2214/03; Y10T 29/49117; Y10T 29/49174
USPC ..... 219/672, 635–637, 674, 676
See application file for complete search history.

(56) References Cited

U.S. PATENT DOCUMENTS

| | | | |
|---|---|---|---|
| 6,189,611 | B1 | 2/2001 | Kasevich |
| 8,607,862 | B2 | 12/2013 | Diehl et al. |
| 9,151,146 | B2 | 10/2015 | Rey-Bethbeder et al. |
| 2006/0289485 | A1 | 12/2006 | Kikuchi et al. |
| 2008/0267676 | A1 | 10/2008 | Takai et al. |
| 2011/0006055 | A1 | 1/2011 | Diehl |

FOREIGN PATENT DOCUMENTS

| | | | | |
|---|---|---|---|---|
| CN | 2005 1000974.3 | | * 11/2006 | |
| DE | 102007040605 | B3 | 10/2008 | |
| EP | 2250858 | A1 | 11/2010 | |
| FR | 2947587 | A1 | 1/2011 | |
| JP | 2004494560 | A | 10/2004 | |
| WO | WO 2009109489 | A1 * | 9/2009 | ..... E21B 36/04 |

* cited by examiner

METHOD FOR PRODUCING A CABLE CORE, HAVING A CONDUCTOR SURROUNDED BY AN INSULATION, FOR A CABLE, IN PARTICULAR FOR AN INDUCTION CABLE, AND CABLE CORE AND CABLE

CROSS-REFERENCE TO RELATED APPLICATION

This is a continuation application, under 35 U.S.C. § 120, of copending international application No. PCT/EP2012/004929, filed Nov. 29, 2012, which designated the United States; this application also claims the priority, under 35 U.S.C. § 119, of German patent application No. DE 10 2011 087 680.4, filed Dec. 2, 2011; the prior applications are herewith incorporated by reference in their entireties.

BACKGROUND OF THE INVENTION

Field of the Invention

The invention relates to a method for producing a cable core, having a conductor surrounded by insulation, for a cable, in particular for an induction cable. The invention further relates to a cable core of this type and also to a cable, in particular an induction cable having a plurality of cable cores of this type. The cable cores respectively have a conductor surrounded by insulation and are interrupted in the cable longitudinal direction at predefined length positions at separation points.

A cable of this type serves, in particular, for use as a so-called induction cable for the formation of one or more induction fields. The cable is intended, in particular, for the inductive heating of deposits of oil sand and/or of extra-heavy oil. Such an application of an induction cable of this kind can be derived, for example, from European patent EP 2 250 858 B1, corresponding to U.S. patent publication No. 2011/0006055. The technical boundary conditions resulting from this application are met by the cable which is described below.

For the construction of the induction fields or of the inductive heating system, it is necessary that the individual cores of the cable, at defined separation points, are separated in a contact spacing having a defined length of, for instance, several tens of meters. Within the cable, a plurality of cores is preferably combined into conductor groups, wherein the separation points or interruptions of the cores of a respective conductor group are situated at the same length position.

A cable of this type is laid in the ground (oil sand) and serves for the inductive warming of the oil sand in order to liquefy, and suitably collect, the oil bound in the oil sand.

This technique is still comparatively young and is still in the trial stage. For large, industrial-scale applications, an inexpensive and, in process engineering terms, secure production of an induction cable of this type, which can have a length of several km, is of advantage.

SUMMARY OF THE INVENTION

Accordingly, the object of the present invention is to enable an, in process engineering terms, secure and reliable production of a cable of this type and to define an appropriate cable.

The object is achieved according to the invention by a method for producing a cable core. The cable core contains a conductor surrounded by insulation and is configured for use in an induction cable. To this end, the cable core is interrupted in the cable longitudinal direction at predefined length positions at separation points. For the production of a cable core of this type, a crude core is firstly fed continuously, i.e. in a continuous process, to a processing machine. The crude core is recurrently separated in the processing machine, in particular regularly at predefined length positions at a respective separation point, so that two core ends exist. The free core ends are hereupon gripped by a gripping element of the processing machine and are pulled apart in the cable longitudinal direction. After this, the two core ends are reconnected to each other with a connector, so that a continuous strand is recreated. The connector here has an insulating spacer part, in particular formed of a solid material, which spacer part is disposed between the two core ends and separates these from each other by a predefined distance.

By virtue of this embodiment, a process-reliable and automated production process for a cable core of this type is enabled. From the cable cores which have been prepared in this way, the actual cable is produced in a following method step.

With a view to an economical production process, in a particularly advantageous embodiment an extrusion coating of the core ends for the formation of the connector is provided. To this end, an injection mold is provided as part of the processing machine, which injection mold, during the continuous process, encloses the mutually separated core ends at the separation point. Next, the injection molding compound, containing a suitable plastic insulation material, is injected, so that the connector is configured with the insulating spacer part between the core ends and with sleeve portions surrounding the core ends.

With regard to the desired field of application for use in an induction cable, the cable ends are enclosed in a snug-fitting manner within the connector, in particular in an airtight and, furthermore, also airless arrangement. The core ends are therefore embedded fully, and without gas pockets, within the material of the connector. This is achieved in a particularly simple manner by the preferred injection method.

As an alternative to the injection method, a connector which is preferably likewise configured as an injection molded part is fed as a prefabricated component to the processing machine and the core ends are introduced into opposing sleeve portions of the connector, where after these sleeve portions are connected to the core ends.

With regard to the tightly enclosing binding of the connector to the insulation, the latter is preferably integrally connected to the material of the connector. This is realized, in particular, by a heat treatment and the use of suitable materials, which, when warmed, at least soften or partially melt. As the material both for the connector and for the at least outermost position of the insulation of the cable core, a thermoplastic material is therefore preferably used.

Accordingly, a similar and, in particular, same material is also used also for the connector on the one hand and for the insulation on the other hand, at least for an outer insulation layer. This is, in particular, a high-temperature resistant plastic, preferably perfluoroalkoxy polymer (PFA).

The connector and at least contiguous segments of the core, preferably the entire core, are surrounded with a banding, in particular of polytetrafluoroethylene (PTFE). This is preferably in turn subjected to a temperature treatment, in particular a sintering process, so as to connect it as integrally as possible to the insulation of the core and to the connector. As a result, a torsionally rigid wiring core is produced overall, which wiring core is electrically interrupted at defined separation points. At the separation points, the respective core ends are connected to one another by the respective connector, with the release of the insulation spacer part, whereby, so to speak, a window is formed. As a result of the fusion of the core ends in the sleeve, in particular also in conjunction with the sintered PTFE banding, in addition to the high torsional rigidity also a high tensile strength, in particular in the region of the connector, is obtained.

With a view to a method which is as economical as possible, the production of the cable core is realized in the course of a re-reeling operation. The crude core is here provided as a continuous product on a take-off reel and unwound from this, led through the processing machine and subsequently, after the attachment of the individual connectors, rolled up again by a take-up reel.

In the course of the production method, in an expedient refinement the cable core is subjected to an on-line quality control, i.e. the quality of the connections at the separation points is checked continuously.

Above all, an electrical checking of the connectors is conducted. The connector—after having been removed from the injection mold after a defined cooling time—is subjected to a partial discharge test. It is herein checked whether the connector, at a predefined voltage, has the desired insulation properties, before the cable core is then reeled onto the take-up reel.

In addition, a mechanical (tensile) testing device, if required, is integrated into the process chain. Apart from this, further processing units are also—where necessary—integrated in the process chain, such as, for instance, an additional welding unit or a banding unit. In addition, in particular also an additional temperature control unit, in particular for the thermal treatment (sintering process) of the applied banding, is provided.

At the end of the production process for the cable core, the latter is therefore available, wound on a reel, for further processing. In a following method step, which can be take place at a later moment and also at another location, the individual cable cores are then used to produce the actual cable. This has at the end a plurality of such cable cores, which are surrounded by a common cable sheath. For the production of the cable, the individual cable cores are preferably, if need be, multiply stranded together.

The individual cable cores are here positioned relative to one another in such a way that the individual separation points of at least one group of cable cores are disposed at the same length position. A plurality of groups of cable cores can be provided (for instance 2 or 3), the separation points of which are oriented respectively at the same length position, wherein the separation points of the cable cores of different groups are arranged mutually offset.

The distance between the connector, and thus the separation points, typically measures around several meters, in particular several tens of meters. The separation points are here arranged in a predefined, in particular constant contact spacing.

The cable here expediently contains a plurality of stranded elements, which on one side consist of a plurality of stranded-together cable cores and which are themselves, in turn, stranded together. The cable which is produced in this way has a length of typically at least several 100 meters up to several km. In the light of the sought purpose of application, namely as an induction cable for the warming of oil sands, it is configured overall to be high-temperature resistant for a temperature greater than 200° C. Accordingly, the materials used are also configured for a temperature of this magnitude.

This method therefore allows a fully automated production of a cable of this type, wherein recourse is made to traditional cable production steps, such as the stranding process, etc.

Other features which are considered as characteristic for the invention are set forth in the appended claims.

Although the invention is illustrated and described herein as embodied in a method for producing a cable core, having a conductor surrounded by an insulation, for a cable, in particular for an induction cable, and cable core and cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
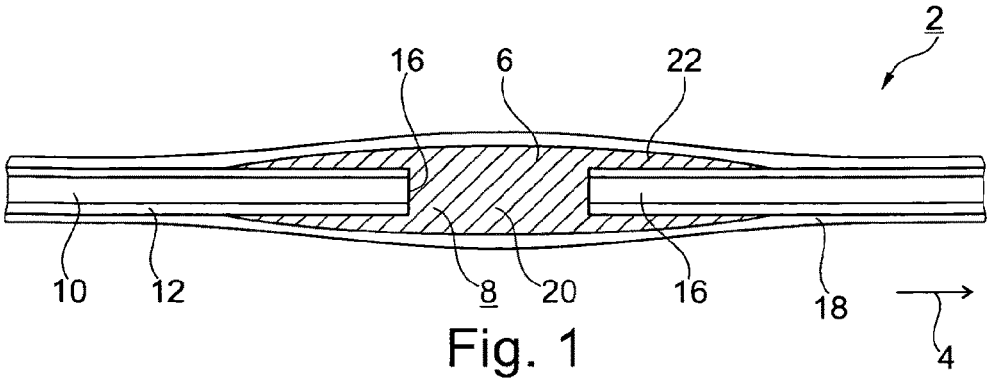
FIG. 1 is a diagrammatic, partial sectional view of a first variant of a cable core, connected at a separation point by a connector, according to the invention.
Figure 2:
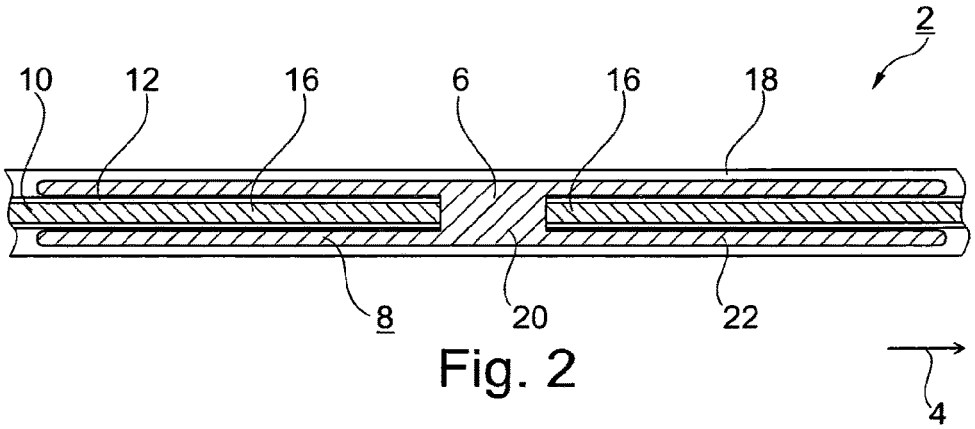
FIG. 2 is a sectional view, comparable to FIG. 1, according to a second variant of the invention.
Figure 3:
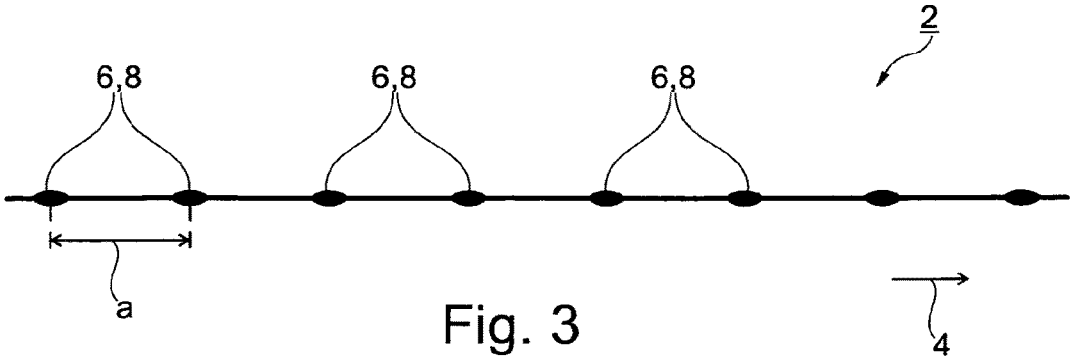
FIG. 3 is a side view of the cable core.

Referring now to the figures of the drawings in detail and first, particularly to FIGS. 1-3 thereof, there is shown in various representations a cable core 2, which extends in a cable longitudinal direction 4 and which, at periodically recurring connecting points 6, respectively has a connector 8. The separation points 6 are configured in a predefined contact spacing a.

The cable core 2 contains a central electrical conductor 10, which is surrounded by insulation 12. The insulation 12 is preferably constituted by a multilayered insulation 12 containing different insulating materials, which are respectively high-temperature resistant. According to a first variant, the insulation 12 contains only one insulation layer, preferably of PFA. According to a second variant, the insulation 12 contains two layers, preferably one layer of PFA and a further layer of a PTFE applied, in particular, as a banding. According to a third variant, three layers are provided, wherein preferably a PTFE banding is embedded in a sandwich-like manner between two PFA insulation layers. Finally, according to a fourth variant there is provided an, in total, four-layered structure, in which, in turn, in a preferred embodiment, two intermediate layers are provided between two PFA coatings. The two intermediate layers are here preferably a banded PTFE and banded mica. The variants containing an intermediate layer embedded between two PFA layers and configured, in particular, as a banding, shows particularly good mechanical stability.

As the electrical conductor 10, a wire, in particular a copper wire, and preferably a nickel-plated copper wire, is used. Alternatively, a stranded wire, for instance a copper or a nickel-plated copper stranded wire, containing a multiplicity of individual wires, can also be used.

From a crude core 14 is formed the cable core 2 containing the conductor 10 and the insulation 12. To this end, the crude core 14 is interrupted at the separation points 6, so that two opposing core ends 16 are formed. These are mutually connected by a connector 8. Common to both configuration variants of FIGS. 1 and 2 is the fact that the connector 8 enters into integral connection with the insulation 12 of the core ends 16. In addition, in both configuration variants there is provided a further additional banding 18, in particular of PTFE, with which the connector 8 and the contiguous segments of the crude core 14 are enwrapped. The banding 18, too, is preferably likewise integrally connected to the connector 8 and to the insulation 12.

The connector 8 is in both cases formed by a solid spacer part 20, which is respectively adjoined in opposite arrangement by sleeve portions 22, in which the core ends are held in a gas-free and gas-tight fitting.

Both connectors 8 are constituted by injection molded parts. As the material, preferably the same material as the outermost cover of the insulation 12 is used, in particular PFA. Due to the use of a thermoplastic, the desired integral connection can be obtained in a simple manner through the introduction of heat.

In the configuration variant according to FIG. 1, this occurs in a particularly favorable manner in process engineering terms by virtue of the fact that the connector 8 is formed directly on the crude core 14 with the separated core ends 16 by an injection molding process.

By contrast, in the configuration variant of FIG. 2, a prefabricated connector 8 is provided in the production process, into which connector the core ends 16 are respectively introduced, where after the sleeve portions 22 are integrally connected to the core ends 16, for instance by pressing and/or heat treatment.

The connector 8 has a length, in total, of preferably several cm, for instance within the range from 5 cm to 15 cm. The length of the spacer part 20 here lies within the range from 5 mm to 20 mm. The diameter of the crude core 14, and thus approximately the inner diameter of the sleeve portions 22, preferably lies approximately within the range from 1 mm to 3 mm. The wall thickness of the sleeve portions 22 preferably lies within the range from 0.3 mm to 1 mm. In total, the connector 8 is symmetrical in construction. The contact spacing a between the connectors 8 measures in the region of several tens of meters.

Figure 4:
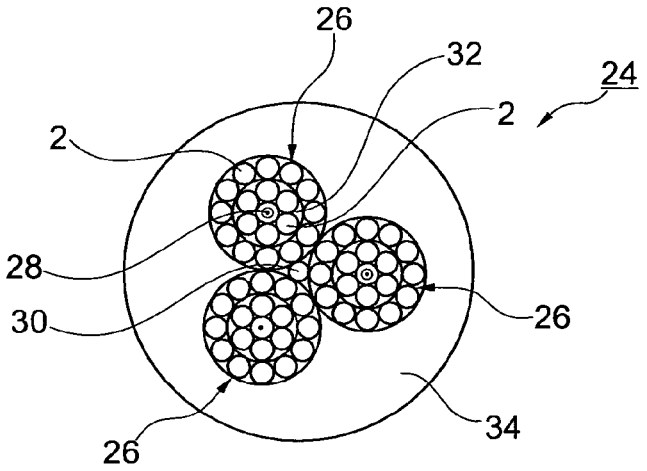
FIG. 4 is a cross-sectional view of an induction cable.

An exemplary conductor structure of an induction cable 24 is represented in FIG. 4.

According to this, the induction cable 24 has a total of three elements 26, which are respectively formed of a plurality of stranded together cable cores 2. In the illustrative embodiment, each element 26 has a central optical waveguide fiber 28, which is concentrically surrounded by a first core layer containing six cable cores 2. The first core layer is subsequently surrounded by a second core layer, in the illustrative embodiment containing twelve individual cable cores 2. The individual core layers are produced in a stranding process. In the gap between the three elements 26, a further filling element 30, in particular made of glass silk or aramid, is disposed. The first layer containing the six stranded together cable cores 2 can be surrounded—as represented in the illustrative embodiment—by an intermediate casing 32, for instance of silicone. The three thus constructed elements 26 are in turn stranded together and subsequently surrounded with a cable sheath 34, in particular of silicone. The elements here respectively have a diameter, for instance, of about 10 mm. The entire cable 24 has a diameter, for instance, of around 25 mm.

In principle, the induction cable 24 is also suitable for other applications, for example for laying in a factory floor of a production workshop for the control of industrial robots which travel on the factory floor. Or for the heating of, for instance, oil-transporting pipes (pipeline).

Figure 5:
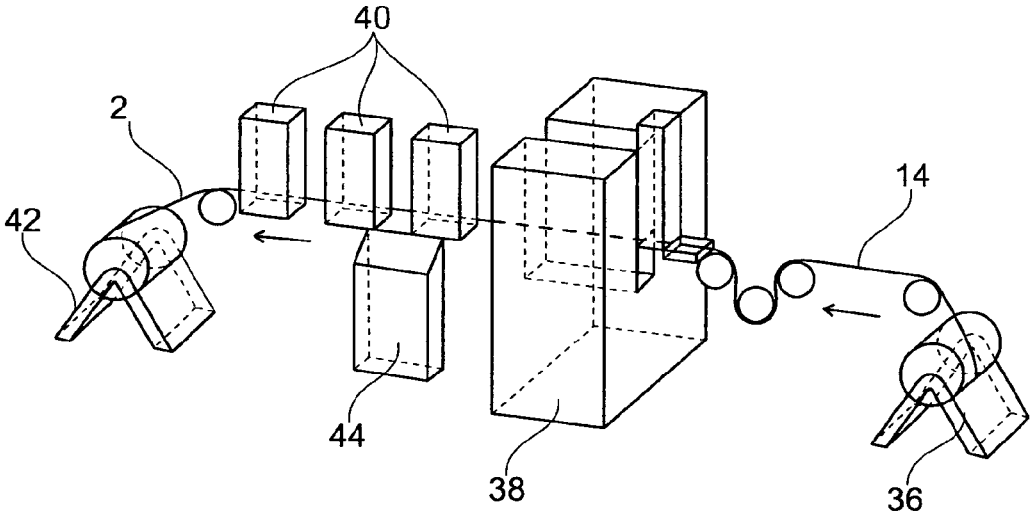
FIG. 5 is a perspective view of a simplified production line for a production of the cable core.

The method for producing the cable core 2 is explained in greater detail with reference to FIG. 5. The crude core 14 is provided on a take-off reel 36 and is led from this, via various deflection rollers of a processing machine, to and through the latter, where after it is led through a plurality of partially optional further processing and monitoring stations 40 and, at the end of the production process, is immediately wound up again, as a finished cable core 2, by a take-up reel 42. The cable core 2 is then available for the actual operation of producing the cable 24 by stranding processes.

The production of the cable core 2 from the crude core 14 is therefore realized, in total, in a continuous, ongoing process during a re-reeling operation. Within the processing machine 38, the separation of the crude core 14 and the subsequent connection to the connector takes place. In the preferred design variant, the processing machine 38 contains an injection molding tool for the online formation of the connector 8 by an injection molding process. To this end, the crude core 14 is firstly held at the provided separation point 6 by two gripping elements and then separated, whereupon the two core ends 16 are pulled apart by a desired distance of 1 cm to 2 cm. Finally, the core ends 16 are inserted into the injection mold. To this end, the latter preferably has two shell halves, which, perpendicularly to the cable longitudinal direction, moves up to the core ends 16 and encloses these. After this, the injection molding compound is introduced. After a certain cooling time, the injection mold reopens and the cable core 2 is led onward. Following this process of applying the connector 8, in a preferred embodiment the application of the banding 18, with subsequent sintering for integral fastening of the banding 18, further takes place. This is realized, for instance, in one of the following processing stations 40. A further processing station 40 is configured as a checking station for on-line quality control. Studies have shown that, in the here chosen embodiment containing the direct extrusion coating of the core ends 16, a very good mechanical connection is obtained, so that a separate mechanical tensile test for the respective connector 8 is waived.

An at least similar production process is also used in the embodiment of FIG. 2. Instead of the online extrusion coating, however, the prefabricated connector 8 is here provided in the processing machine 38. The core ends 16 are introduced into the sleeve portions 22 with the aid of the gripping elements. In a following process step, the integral connection of the core ends within the connector 8 is realized, for instance, by warming and press-molding. The entire production process, as represented in FIG. 5, is controlled, for instance, by a control unit 44.

The following is a summary list of reference numerals and the corresponding structure used in the above description of the invention:

2 cable core
4 cable length direction
6 separation point
8 connector
10 conductor

12 insulation
14 crude core
16 core end
18 banding
20 spacer part
22 sleeve portion
24 induction cable
26 element
28 optical waveguide fiber
30 filling element
32 intermediate casing
34 cable sheath
36 take-off reel
38 processing machine
40 processing station/monitoring station
42 take-up reel
44 control unit
a contact spacing

The invention claimed is:

1. A method for producing a cable, which comprises the steps of:

producing a plurality of cable cores, each of the cable cores being produced by the further steps of:

feeding a crude core continuously to a processing machine and there, recurrently, at predefined length positions the crude core is separated at a separation point, so that at the separation point two core ends exist, said crude core haying an insulation surrounding a conductor;

pulling apart the core ends in a cable longitudinal direction; and reconnecting the two core ends with a connector, the connector having an insulating spacer part for separating the core ends from each other by a predefined distance, the core ends in the cable longitudinal direction fastened on both sides of the insulating spacer part to the connector, the insulating spacer part being disposed between the core ends and separating the core ends from each other by the predefined distance, the connector being integrally connected to the insulation and the insulation haying a first width and a first length, the connector haying a second width being greater than the first width of the insulation and a second length being less than the first length of the insulation;

stranding together the plurality of cable cores resulting in stranded cable cores; and surrounding the stranded cable cores with a cable sheath to form the cable.

2. The method according to claim 1, which further comprises extruding the mutually separated core ends for a formation of the connector.

3. The method according to claim 1, which further comprises applying a banding to a cable core and the connector.

4. The method according to claim 3, which further comprises integrally connecting the banding to the insulation and/or the connector.

5. The method according to claim 1, wherein a separation and connection of the crude core takes place in a re-reeling operation.

6. The method according to claim 1, wherein the cable is an induction cable.

7. A cable, comprising:

a cable sheath; and a plurality of cable cores stranded together and surrounded by said cable sheath, each of said cable cores containing:

a conductor;

insulation surrounding said conductor and having a first width and a first length, wherein each of said cable cores including said conductor and said insulation being interrupted in a cable longitudinal direction at a predefined length position at a separation point, resulting in a formation of two opposing core ends; and a connector extending in the cable longitudinal direction and having an insulating spacer part, said opposing core ends, in the cable longitudinal direction, fastened on both sides of said insulating spacer part to said connector, said insulating spacer part being disposed between said two opposing core ends and separating said two opposing core ends from each other by a predefined distance, said connector integrally connected to said insulation, said connector having a second width being greater than said first width of said insulation and a second length being less than said first length of said insulation.

8. The cable according to claim 7, wherein:

the cable is an induction cable; and said connector having two sleeve portions on opposing sides of said insulating spacer part, said sleeve portions each surrounding one of said two opposing core ends having said conductor and said insulation surrounding said conductor.

9. The cable a according to claim 7, wherein said connector has on both sides of said insulating spacer part a sleeve portion extending in the cable longitudinal direction and in which said opposing core ends are held.

10. The cable according to claim 7, wherein said connector is an injection molded part.

11. The cable according to claim 7, wherein said connector is formed by extrusion coating of said opposing core ends.

12. The cable according to claim 7, wherein said separation point is repeated at a predefined contact spacing, wherein the predefined contact spacing measures in a region of several meters.

13. The cable according to claim 7, wherein said connector and said insulation are formed of a similar material.

14. The cable according to claim 7, further comprising a circumferential banding made of a plastic, said circumferential banding surrounding said connector and at least contiguous segments of said insulation surrounding said conductor.

15. The cable according to claim 14, wherein said circumferential banding is integrally connected to said connector and/or said insulation.

16. The cable according to claim 7, wherein said connector and said insulation are formed of a same material.

17. The cable according to claim 7, wherein:

the cable is an induction cable; and said connector having two sleeve portions on opposing sides of said insulating spacer part, said sleeve portions each surrounding one of said two opposing core ends having said conductor and said insulation surrounding said conductor.

* * * * *